US011110019B2

(12) United States Patent
Novak

(10) Patent No.: US 11,110,019 B2
(45) Date of Patent: Sep. 7, 2021

(54) CONNECTING ELEMENT FOR MEDICAL BEDRAIL, ASSEMBLY COMPRISING IT AND PROCEDURE FOR ASSEMBLING SAID ASSEMBLY

(71) Applicant: NOVAK M D.O.O, Komenda (SI)

(72) Inventor: Miha Novak, Komenda (SI)

(73) Assignee: NOVAK M D.O.O, Komenda (SI)

( * ) Notice: Subject to any disclaimer, the term of this patent is extended or adjusted under 35 U.S.C. 154(b) by 345 days.

(21) Appl. No.: 16/323,290

(22) PCT Filed: May 22, 2017

(86) PCT No.: PCT/SI2017/000011
§ 371 (c)(1),
(2) Date: Feb. 5, 2019

(87) PCT Pub. No.: WO2018/030959
PCT Pub. Date: Feb. 15, 2018

(65) Prior Publication Data

US 2020/0222258 A1 Jul. 16, 2020

(30) Foreign Application Priority Data

Aug. 10, 2016 (SI) ..... P-201600190

(51) Int. Cl.
*A61G 7/05* (2006.01)
*E05D 11/10* (2006.01)
(Continued)

(52) U.S. Cl.
CPC ..... *A61G 7/051* (2016.11); *A61G 7/05* (2013.01); *A61G 7/0507* (2013.01);
(Continued)

(58) Field of Classification Search
CPC .. A61G 7/0518; A61G 7/0507; A61G 7/0509; A61G 7/0508; A61G 7/0526;
(Continued)

(56) References Cited

U.S. PATENT DOCUMENTS 6,364,562 B1 * 4/2002 Tung ..... A45B 17/00 135/20.3
2011/0010857 A1 1/2011 Falbo et al.
(Continued)

FOREIGN PATENT DOCUMENTS

DE 19531983 A1 2/1997
FR 2711522 A1 5/1995
(Continued)

*Primary Examiner* — David R Hare
*Assistant Examiner* — Madison Emanski
(74) *Attorney, Agent, or Firm* — The Watson IP Group, PLC; Jovan N. Jovanovic

(57) ABSTRACT

The proposed invention relates to a connecting element (1) for a medical bedrail, such as used in medical transport gurneys, stretchers, hospital beds and the like. The connecting element (1) connects a connecting rod (2) and a pivotable rod (3) of a foldable bedrail for medical beds and comprises a jaw (4), the inner surface (5) of the jaw (4) being concave in shape and adapted for abutting tightly against the outer surface of the connecting rod (2), two locking teeth (6) fashioned symmetrically on or at the upper edge of the inner surface (5) of the jaw (4), each on one side of the jaw (4), respectively, and two legs (7) fashioned on the upper part of the outer side of the jaw (4) and arranged symmetrically with respect to a central plane (R) extending vertically and longitudinally through the center of the jaw (4), the legs (7) extending downwards, each of the legs (7) comprising a snap-fit element (8) fashioned on the inner surface of the leg (7) facing the inner surface of the other leg (7), the snap-fit elements (8) being arranged symmetrically with respect to the central plane (R) and co-operating with two snap-fit
(Continued)

elements (8) fashioned in the pivotable rod (3). The connecting element (1) may further comprise a centering web (13), located on the bottom of the jaw (4).

10 Claims, 4 Drawing Sheets

(51) Int. Cl.
*E04F 11/18* (2006.01)
*E02F 9/08* (2006.01)
*A47F 5/08* (2006.01)

(52) U.S. Cl.
CPC ..... *A61G 7/0508* (2016.11); *A61G 7/0509* (2016.11); *A61G 7/0518* (2016.11); *A61G 7/0526* (2013.01); *E05D 11/1007* (2013.01); *A47F 5/0853* (2013.01); *E02F 9/0833* (2013.01); *E04F 11/1802* (2013.01); *E04F 11/1808* (2013.01)

(58) Field of Classification Search
CPC ..... A61G 7/051; A61G 7/05; A47F 5/0853; E04F 11/1802; E04F 11/1808; E05D 11/1007; E05D 11/10; E02F 9/0833
See application file for complete search history.

(56) References Cited

U.S. PATENT DOCUMENTS

| | | | | |
|---|---|---|---|---|
| 2014/0134358 | A1* | 5/2014 | Hart | E04F 11/1808 428/34.1 |
| 2018/0106085 | A1* | 4/2018 | Lapchev | E05D 11/10 |

FOREIGN PATENT DOCUMENTS

| | | | |
|---|---|---|---|
| FR | 3011177 | A1 | 4/2015 |
| JP | 2008194448 | A | 8/2008 |
| WO | 2013178196 | A1 | 12/2013 |

* cited by examiner

CONNECTING ELEMENT FOR MEDICAL BEDRAIL, ASSEMBLY COMPRISING IT AND PROCEDURE FOR ASSEMBLING SAID ASSEMBLY

The proposed invention relates to a connecting element for a medical bedrail, such as used in medical transport gurneys, stretchers, hospital beds and the like.

According to the international patent classification, the invention pertains to the technical field of medicine, specifically to the field of medical bed equipment, and more specifically to side-rails or guard-rails for medical beds.

The invention addresses the problem of providing a connecting element which will allow the rail to be assembled in a quick and simple fashion while ensuring a sturdy connection/assembly of the rail elements, namely of the connecting rod and the pivotable rods, while presenting as few unsmooth surfaces as possible, which is a major concern in medical beds due to the importance of cleaning.

The inventive connecting element may be used in rails for medical beds, such as hospital beds, stretchers, gurneys for transporting persons in the reclined position, wherein the rail has at least two positions: the folded position and the deployed position. The connecting element is designed such that it allows quick switching of the rail position from the folded to the deployed position. This enables patients to be transferred from one bed to another quickly and easily when the rail is in the folded position, while guaranteeing safety so that the patient doesn't fall off the bed when the rail is in the deployed position. When the rail is in the deployed position, it is secured with prior art locking mechanisms which are not an object of the invention as claimed. In practice, the rail is also used for moving the bed when the latter is provided with wheels, so it is desirable that the connecting elements provide a sturdy connection/assembly when the rail is in the deployed position.

Such prior art bedrails consist of interconnected rods. The upper part of the rail is usually represented by a connecting rod, rotationally connected to at least two, and generally more, pivotable rods, which are, in turn, rotationally connected in their lower part to the edge of the bed. When the rail is in the deployed position, the upper part of the rail is arranged essentially horizontally, while the pivotable rods are arranged essentially vertically. When the rail is in the folded position, the pivotable rods pivot about their rotational axes, while the connecting rod descends, still in an essentially horizontal arrangement, approaching the edge of the bed.

Patent application US 2011/0010857 discloses a side rail of a gurney for transporting persons in a reclined position, wherein the rotational connection between the connecting rod and the pivotable posts is accomplished by means of connecting elements having two parts, wherein one part is fashioned as a U-shaped element and welded to the connecting rod, while the other part is fashioned as a pin conveniently secured to both legs of the U-shaped element and passing through the respective pivotable post, thus allowing the pivotable posts to rotate freely about the pins.

In Pat. DE 19531983 a side rail is disclosed wherein the connecting rod is fashioned as a U-shaped profile into which the pivotable rods are folded away when the rail is in the folded position. At least one of the pivotable rods presents in its upper portion a snap-lock mechanism for securing the rail in the deployed position. The connection between the connecting rod and the pivotable rods is rotational and is achieved by means of connecting elements which likewise consist of a plurality of elements, in a fashion similar to the aforementioned US application.

It is a disadvantage of the solutions discussed above that the connecting elements always consist of at least two parts, meaning that the rail assembly procedure is time-consuming, a special tool is required for assembling and disassembling, replacement of the connecting elements is time-consuming, and the rail exhibits several unsmooth surfaces, which renders adequate cleaning of the rail and its connecting elements difficult.

Said disadvantages are overcome with the connecting element according to the invention. The present invention relates to a connecting element between the connecting rod and the pivotable rods of a rail which allows simple assembling of the rail, which means that less time is needed for assembling the rail, there are no bolts, no bolting, no special tool is required for assembling the rail, there are fewer components, there are no additional moving parts which consequently reduces the manufacturing costs while extending the durability of the rail. The inventive connecting element provides a sturdy connection, since the rail may also serve as a bed handle when the bed needs to be moved. In the event of a failure of an individual connecting element, the replacement thereof is simpler. The connecting element may be fashioned in one piece, meaning that there are fewer unsmooth surfaces, which is a major concern in medical beds due to the importance of cleaning.

The invention shall hereinafter be described with reference to an embodiment thereof and the accompanying illustrations, representing:

Figure 1:
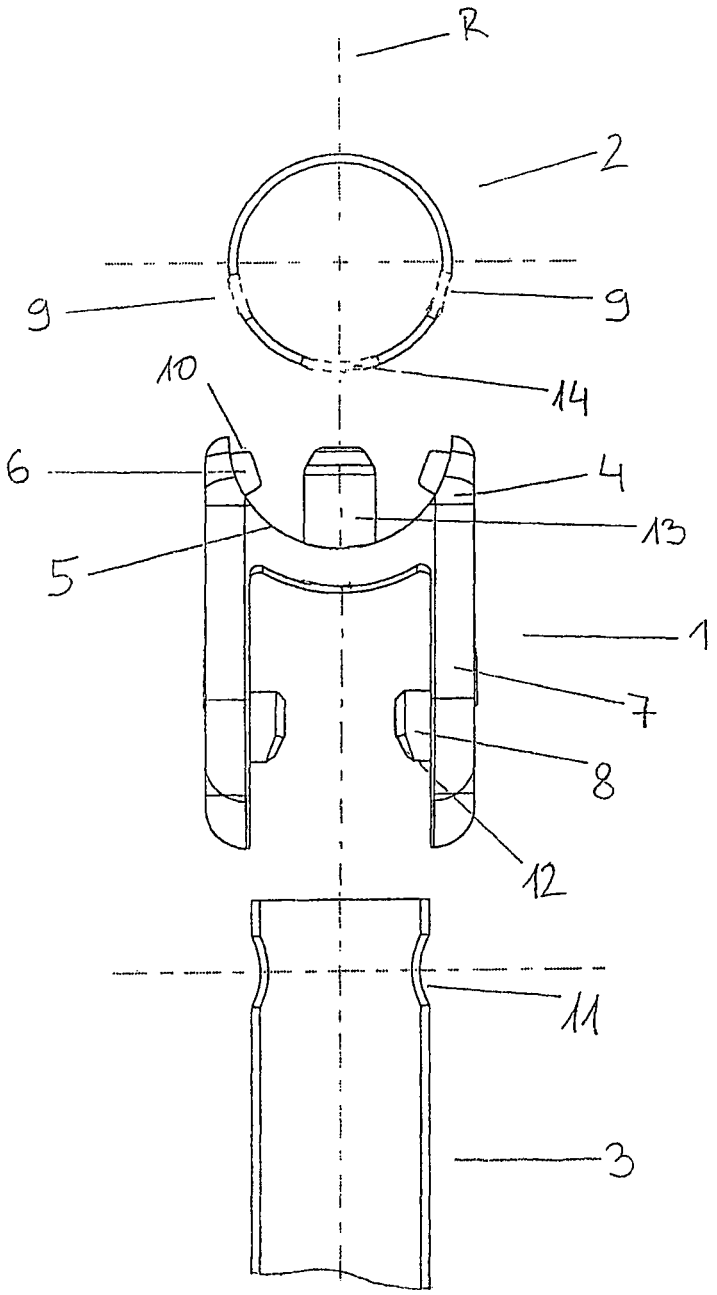
FIG. 1 represents the connecting element with the connecting rod and the pivotable rod in a disassembled sectional view.
Figure 2:
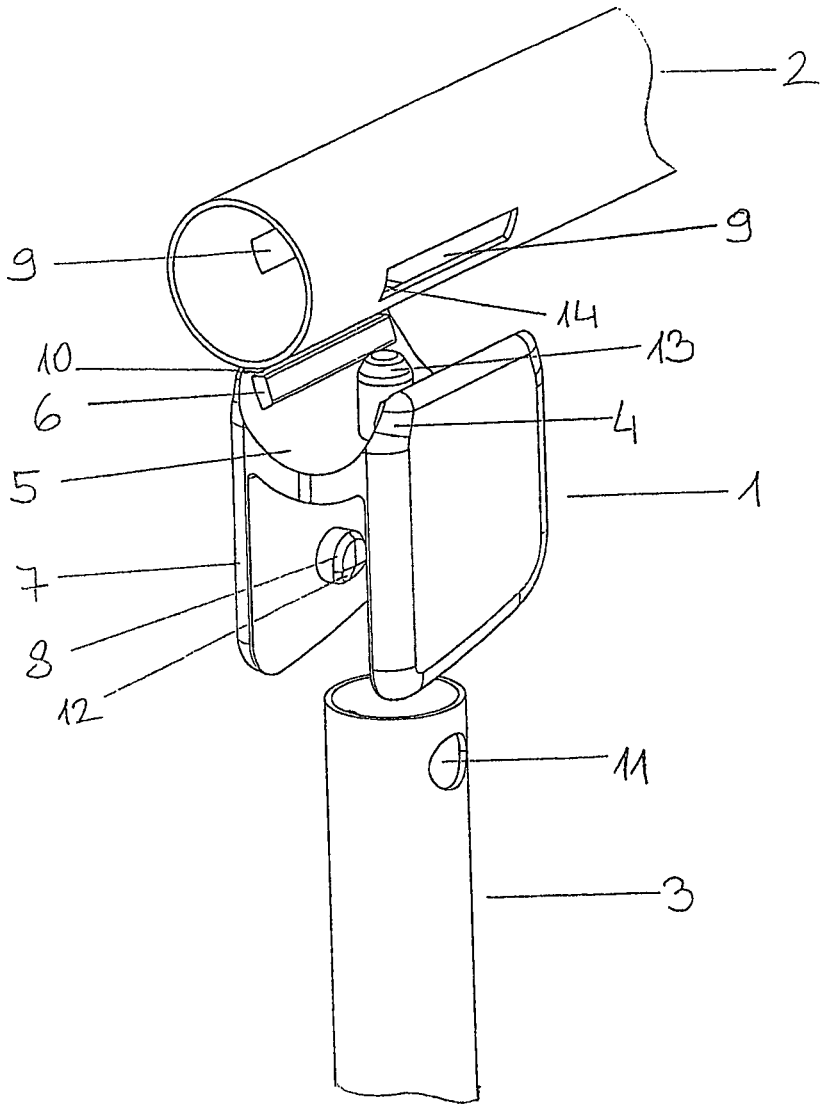
FIG. 2 represents the connecting element with the connecting rod and the pivotable rod in a disassembled perspective view.
Figure 3:
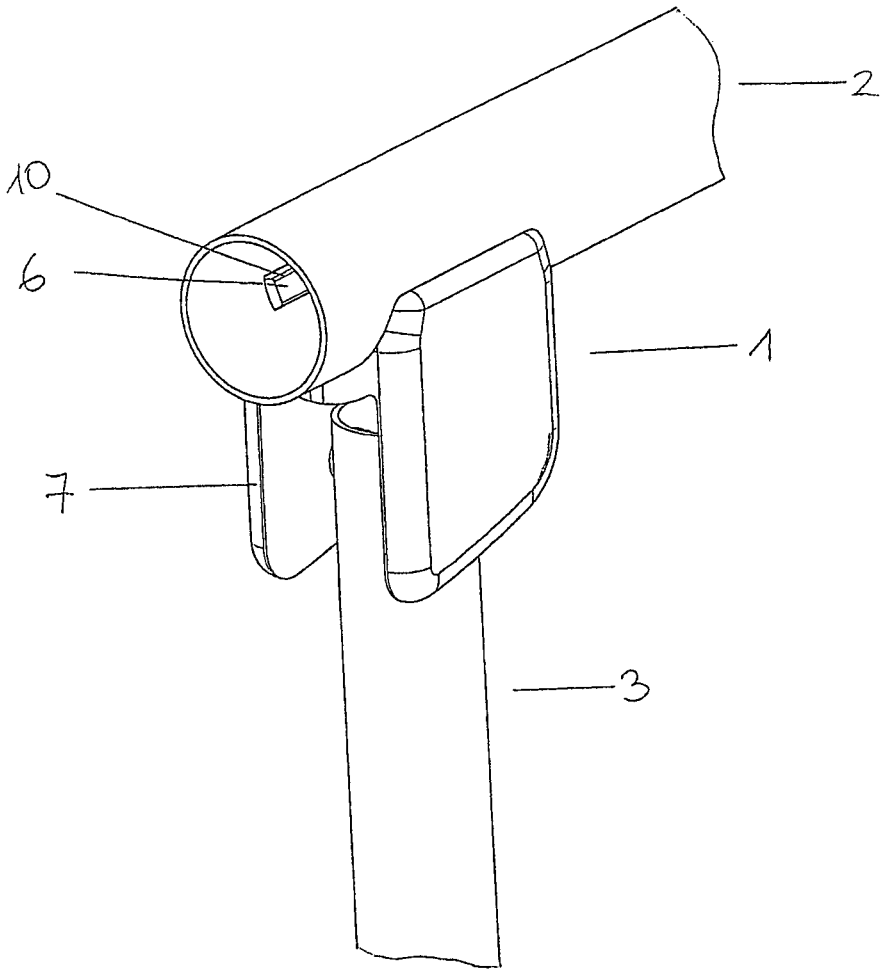
FIG. 3 represents the connecting element with the connecting rod and the pivotable rod in an assembled perspective view.
Figure 4:
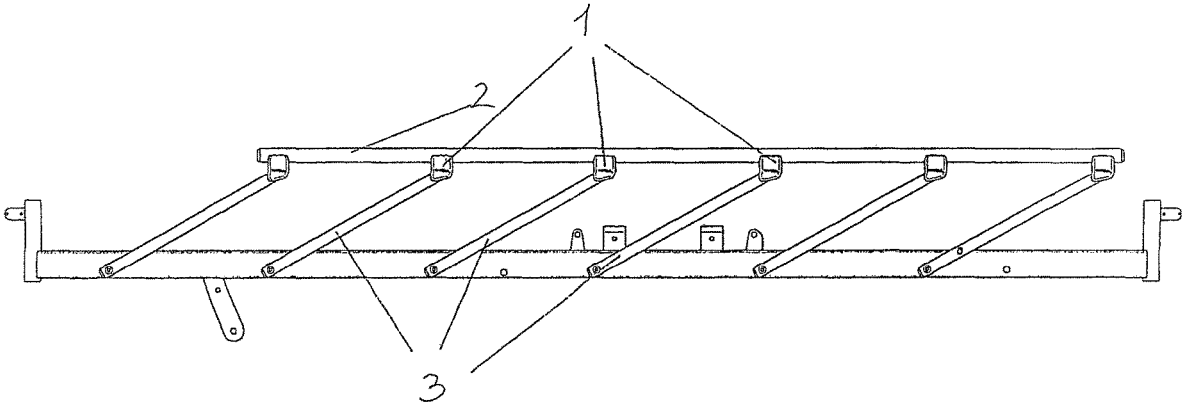
FIG. 4 represents the foldable medical bedrail with connecting elements.

The connecting element 1, shown in FIGS. 1 to 3, comprises a jaw 4, the inner surface 5 of the jaw 4 being concave in shape and adapted for abutting tightly against the outer surface of the connecting rod 2, two locking teeth 6 fashioned symmetrically on or at the upper edge of the inner surface 5 of the jaw 4, each on one side of the jaw 4, respectively, and two legs 7 fashioned on the upper part of the outer side of the jaw 4 and arranged symmetrically with respect to a central plane R extending vertically and longitudinally through the center of the jaw 4, the legs 7 extending downwards, generally parallel to or preferably forming an angle with the central plane R, so that the legs 7 approach each other in their lower part. Each of the legs 7 comprises a snap-fit element 8 fashioned on the inner surface of the leg 7 facing the inner surface of the other leg 7, the snap-fit elements 8 being arranged symmetrically with respect to the central plane R.

The connecting rod 2 and the pivotable rods 3 are preferably fashioned as tubes with a circular cross section, but may evidently be fashioned as tubes or solid bars of various cross sections or profiles. The connecting rod 2 exhibits locking slots 9 in places where the connecting rod 2 connects to the pivotable rod 3 via the connecting element 1.

The locking teeth 6 are preferably oblong and extend along almost the entire length of the inner surface 5 of the jaw 4.

The locking teeth 6 are insertable in a snap-fit engagement into the corresponding locking slots 9 in the connecting rod 2. When the corresponding connecting element 1 and the connecting rod 2 are connected, forming a joint between them, the locking teeth 6 in combination with the locking slots 9 prevent mutual displacement of the corresponding connecting element 1 and the connecting rod 2 in any direction. Preferably, a chamfer 10 is fashioned on the upper edge of the locking tooth 6, so that it may readily snap into the locking slot 9, which facilitates the assembling, i.e. the connecting of the connecting element 1 and the connecting rod 2.

At its connecting end, the pivotable rod 3 presents two snap-fit openings 11, fashioned symmetrically with respect to the central plane R and co-operating with the snap-fit elements 8. The snap-fit elements 8 and the corresponding snap-fit openings 11 are fashioned such as to allow the pivotable rod 3 to be rotated in the central plane R. The snap-fit element 8 is preferably shaped as a protrusion having a circular cross section and fits the circular snap-fit opening 11 in the pivotable rod 3. More preferably, a chamfer 12 is fashioned on the lower edge of the snap-fit element 8 to facilitate the insertion of the pivotable rod 3 into the connecting element 1.

When the connecting element 1 isn't connected with the pivotable rod 3, the distance between the inner faces of the legs 7 is at least equal to, and preferably smaller than, the outer diameter of the pivotable rod 3. When the connecting element 1 is connected to the pivotable rod 3, forming a joint between them, the distance between the inner faces of the legs 7 is equal to the outer diameter of the pivotable rod 3.

The connecting element 1 may optionally comprise a centering web 13 located on the bottom of the jaw 4, preferably at the center of the inner concavely shaped surface 5 of the jaw 4. In that case, the connecting rod 2 exhibits centering slots 14 in places where the connecting rod 2 connects to the connecting rod 2 via the connecting element 1. Each centering slot 14 on the connecting rod 2 is preferably fashioned centrally between the two corresponding locking slots 9. In the assembled position, the centering web 13 fits the centering slot 14, thus additionally preventing mutual displacement of the connecting element 1 and the connecting rod 2 in the longitudinal direction. The height of the centering web 13 is such that it co-operates with the centering slot 14 during assembly even before the connecting rod 2 is pressed into the jaw 4, flexing it apart, whereby precise fitting of the locking teeth 6 into the locking slots 9 is ensured during assembly. Preferably, the centering web 13 is cylindrically shaped with a circular cross section and the centering slot 14 has a circular cross section, so that they fit each other.

The connecting element 1 is preferably fashioned in one piece.

When assembling the rail, which is to say, connecting/forming joints between the connecting elements 1 with the connecting rod 2 and the pivotable rods 3, the connecting element 1 is first joined to the connecting rod 2 by pressing the connecting rod 2 into the jaw 4 of a connecting element 1, whereby the jaw 4 is flexed apart due to the elasticity of the material, ensuring precise fitting of the locking teeth 6 into the locking slots 9. Subsequently, the connecting element 1 and the pivotable rod 3 are joined by inserting/pressing the particular pivotable rod 3 between the legs 7 of the particular connecting element 1. The elasticity of the material allows the legs 7 to be outwardly flexed apart and the snap-fit elements 8 to snap into the corresponding snap-fit openings 11. In a preferred embodiment, owing to the design of the connecting element 1, to the flexing apart of the legs 7, and to the connecting element 1 being fashioned in one piece, part of the elastic force of the material which allows the legs 7 to be flexed during the insertion of the pivotable rod 3 into the connecting element 1 is transferred to the jaw 4, thus additionally strengthening the joint between the jaw 4 and the connecting rod 2. In this way, when the connecting rod 1 and the pivotable rod 3 are connected by means of the connecting element 1, the joint between the connecting element 1 and the connecting rod 2 reinforces the joint between the connecting element 1 and the pivotable rod 3, and vice versa. Thusly, a sturdy assembly is formed, consisting of the connecting rod 2, the connecting element 1, and the pivotable rod 3.

In a preferred embodiment, the connecting element 1 further comprises a centering web 13. In this case, when assembling the rail, the centering web 13 is first inserted into the centering slot 14, and subsequently the connecting rod 2 is pressed into the jaw 4 of the particular connecting element 1.

The connecting element 1 is made of a strong, elastic material. The choice of the material to produce the connecting element 1 from is important because the elasticity of the material, namely the elastic force thereof, prevents the legs 7 from flexing apart while the connecting element 1 is connected to the pivotable rod 3. In addition, as described above, while the legs 7 are being outwardly flexed apart, the connecting element 1 being fashioned in one piece, part of the elastic force of the material which enables the legs 7 to be flexed during the insertion of the pivotable rod 3 into the connecting element 1 is transferred to the jaw 4, thus additionally strengthening the joint between the jaw 4 and the connecting rod 2. The material from which the connecting element 1 is produced is preferably polyamide 6, which is convenient for quick injection molding and exhibits good thermal stability, excellent dimensional stability, high toughness and elasticity, and high chemical resistance. More preferably, the material is Promyde B30 P, manufactured by Nurel S. A.

The invention claimed is:

1. A connecting element for a medical bedrail:

wherein the connecting element connects a connecting rod and a pivotable rod of a foldable bedrail for medical beds, including at least one of stretchers, beds and gurneys, the foldable bedrail having at least two positions, namely a folded position and a deployed position, wherein the connecting element comprises:

a jaw, an inner surface of the jaw being concave in shape and adapted for abutting tightly against an outer surface of the connecting rod, two locking teeth fashioned symmetrically on or at an upper edge of the inner surface of the jaw, each on one side of the jaw, respectively, and adapted for co-operating with locking slots fashioned in the connecting rod, and two legs fashioned on an upper part of an outer side of the jaw and arranged symmetrically with respect to a central plane (R) extending vertically and longitudinally through a center of the jaw, each of the two legs comprising a snap-fit element fashioned on an inner surface of one of the two legs facing an inner surface of another of the two legs, the snap-fit elements being arranged symmetrically with respect to the central plane (R) and co-operating with two snap-fit openings fashioned in the pivotable rod, the snap-fit elements and the corresponding snap-fit openings being fashioned to allow the pivotable rod to be rotated in the central plane (R).

2. The connecting element according to claim 1, wherein the two locking teeth are oblong and extend along substantially an entire length of the inner surface of the jaw, a chamfer being fashioned on an upper edge of each of the two locking teeth.

3. The connecting element according to claim 1, wherein the snap-fit element is fashioned in a shape of a protrusion having a circular cross section, a chamfer being fashioned on a lower edge of the snap-fit element.

4. The connecting element according to claim 1, wherein the two legs extend downwards, forming an angle with the central plane (R), so that the two legs approach each other in their lower part, a distance between inner faces of the two legs being at least equal to an outer diameter of the pivotable rod when the connecting element isn't connected with the pivotable rod, and the distance between the inner faces of the two legs being substantially equal to the outer diameter of the pivotable rod when the connecting element is connected to the pivotable rod.

5. The connecting element according to claim 1, wherein the connecting element further comprises a centering web, located on a bottom of the jaw, at the center of an inner concavely shaped surface of the jaw, and co-operating with a centering slot in the connecting rod.

6. The connecting element according to claim 1, wherein the connecting element is fashioned in one piece from polyamide 6.

7. An assembly for the medical bedrail, the bedrail having at least two positions, namely a folded position and a deployed position, wherein the assembly comprises at least one of the connecting element, the connecting rod and at least one of the pivotable rod according to claim 1, wherein the connecting rod has the locking slots fashioned in places where the connecting rod connects to the pivotable rod via the connecting element, the pivotable rod presenting, at its connecting end, the two snap-fit openings, fashioned substantially symmetrically with respect to the central plane (R) and co-operating with the snap-fit elements, the snap-fit elements and the corresponding snap-fit openings being fashioned such as to allow the pivotable rod to be rotated in the central plane (R).

8. The assembly according to claim 7, wherein, when the connecting element comprises a centering web, the connecting rod exhibits centering slots in places where the connecting rod connects to the pivotable rod via the connecting element, each of the centering slots on the connecting rod being fashioned centrally between two of the locking slots corresponding to the centering slots.

9. A procedure for assembling an assembly for a medical bedrail, the bedrail having at least two positions, namely a folded position and a deployed position, comprising the steps of:

a) pressing a connecting rod into a jaw of a connecting element, whereby the jaw is flexed apart due to an elasticity of a material of the connecting element and a locking teeth fit into locking slots;

b) pressing a pivotable rod between legs of the connecting element, the legs being outwardly flexed apart due to the elasticity of the material; and c) snapping snap-fit elements into corresponding snap-fit openings, with part of an elastic force of the material which allows the legs to be flexed during the pressing of the pivotable rod into the connecting element being transferred to the jaw, this part of the elastic force strengthening a joint between the jaw and the connecting rod.

10. The procedure according to claim 9, wherein, when the connecting element comprises a centering web, insertion of the centering web into a centering slot is carried out prior to step a).

* * * * *